US011823612B2

(12) United States Patent
Mohtashemi et al.

(10) Patent No.: US 11,823,612 B2
(45) Date of Patent: Nov. 21, 2023

(54) CURRENT LOAD TRANSIENT MITIGATION IN DISPLAY BACKLIGHT DRIVER

(71) Applicant: Apple Inc., Cupertino, CA (US)

(72) Inventors: Behzad Mohtashemi, Los Gatos, CA (US); Asif Hussain, Clearwater, FL (US); Feng Guo, Santa Clara, CA (US); Jingdong Chen, San Jose, CA (US); Ming Gu, San Jose, CA (US); Mohammad J Navabi-Shirazi, Phoenix, AZ (US); Omar Alnaggar, Palo Alto, CA (US); Venkataraman V Iyer, Sunnyvale, CA (US); Yang Zhang, Saratoga, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 17/853,247

(22) Filed: Jun. 29, 2022

(65) Prior Publication Data

US 2023/0085621 A1 Mar. 23, 2023

Related U.S. Application Data

(60) Provisional application No. 63/245,613, filed on Sep. 17, 2021.

(51) Int. Cl.
*G09G 3/20* (2006.01)

(52) U.S. Cl.
CPC ... *G09G 3/2092* (2013.01); *G09G 2310/0264* (2013.01); *G09G 2310/08* (2013.01)

(58) Field of Classification Search
CPC ..... G09G 3/2092; G09G 2310/0264; G09G 2310/08; G09G 2320/0247;
(Continued)

(56) References Cited

U.S. PATENT DOCUMENTS 7,224,126 B2 5/2007 Chiou et al.
7,285,923 B2 10/2007 Yu
(Continued)

FOREIGN PATENT DOCUMENTS

AT 16711 U1 7/2020
CN 102630112 B 4/2016
(Continued)

OTHER PUBLICATIONS

Ng, S.K., et al., "Sequential Variable Bilevel Driving Approach Suitable for Use in High-Color-Precision LED Display Panels," IEEE Transactions on Industrial Electronics, vol. 59, No. 12, Dec. 2012, pp. 4637-4645.
(Continued)

*Primary Examiner* — Jose R Soto Lopez
(74) *Attorney, Agent, or Firm* — Fletcher Yoder, P.C.

(57) ABSTRACT

A display device include a first light emitting diode (LED), a second LED, and at least one processor of a driver. The processor drives the first LED and the second LED. The processor determines a first pulse width associated with the first LED and a second pulse width associated with the second LED based on a level of brightness to be emitted by the first LED and the second LED. The processor also receives a gap clock and determines a first pulse start time and a first pulse end time for the first LED based on the first pulse width. Moreover, the processor determines a second pulse start time and a second pulse end time for the second LED based on the first pulse end time, the second pulse width, and/or the gap clock, in which the first pulse end time and the second pulse end time are different.

20 Claims, 7 Drawing Sheets

(58) Field of Classification Search
CPC ..... G09G 2320/064; G09G 2330/025; G09G 3/2014; G09G 3/3426; G09G 3/32
See application file for complete search history.

(56) References Cited

U.S. PATENT DOCUMENTS

| | | | | |
|---|---|---|---|---|
| 7,791,498 | B2 | 9/2010 | Park | |
| 7,888,881 | B2 | 2/2011 | Shteynberg et al. | |
| 8,044,984 | B2 | 10/2011 | Hsu et al. | |
| 8,421,368 | B2 | 4/2013 | Jalbout et al. | |
| 9,019,317 | B2 * | 4/2015 | Lee | G09G 3/3406 345/690 |
| 9,246,378 | B2 | 1/2016 | Walker | |
| 9,717,123 | B1 | 7/2017 | Yao | |
| 9,881,563 | B2 | 1/2018 | Joo et al. | |
| 10,134,337 | B2 | 11/2018 | Lee et al. | |
| 10,269,307 | B2 | 4/2019 | Xie et al. | |
| 10,297,209 | B2 | 5/2019 | Kang | |
| 10,319,294 | B2 | 6/2019 | Lee et al. | |
| 10,512,130 | B1 * | 12/2019 | Ozalevli | G09G 3/3426 |
| 11,074,869 | B2 * | 7/2021 | Chen | G09G 3/3406 |
| 2005/0146532 | A1 * | 7/2005 | Miyazaki | G09G 3/2096 345/600 |
| 2006/0208999 | A1 * | 9/2006 | Lee | G09G 3/3426 345/102 |
| 2007/0152929 | A1 * | 7/2007 | Chan | H05B 41/3927 345/87 |
| 2007/0222744 | A1 * | 9/2007 | Okita | G09G 3/342 345/102 |
| 2008/0055230 | A1 * | 3/2008 | Jang | G09G 3/3406 345/102 |
| 2009/0073110 | A1 * | 3/2009 | Feng | H05B 41/3927 345/102 |
| 2009/0128479 | A1 * | 5/2009 | Yeo | G09G 3/3406 345/102 |
| 2009/0315823 | A1 * | 12/2009 | Chen | G09G 3/3406 345/102 |
| 2009/0322800 | A1 * | 12/2009 | Atkins | G09G 3/3413 345/102 |
| 2010/0053228 | A1 * | 3/2010 | Yeo | G09G 3/3406 345/690 |
| 2010/0149428 | A1 * | 6/2010 | Kishimoto | G09G 3/3426 348/E5.133 |
| 2010/0194721 | A1 * | 8/2010 | Miyata | G09G 3/2096 345/206 |
| 2011/0249036 | A1 * | 10/2011 | Kim | H05B 45/3725 345/690 |
| 2011/0267375 | A1 * | 11/2011 | Yang | H05B 45/46 315/307 |
| 2011/0273104 | A1 * | 11/2011 | Uchimoto | H02M 3/156 315/210 |
| 2013/0169173 | A1 * | 7/2013 | Chen | H05B 45/3725 315/186 |
| 2014/0320039 | A1 * | 10/2014 | Kao | G09G 3/3426 315/250 |
| 2016/0119995 | A1 * | 4/2016 | Han | H03K 5/1532 315/193 |
| 2016/0143103 | A1 * | 5/2016 | Kang | H05B 47/175 315/210 |
| 2016/0275845 | A1 | 9/2016 | Tsai et al. | |
| 2016/0358528 | A1 | 12/2016 | Xie et al. | |
| 2017/0229072 | A1 * | 8/2017 | Xing | G09G 3/3607 |
| 2018/0074644 | A1 * | 3/2018 | Ichihara | G09G 3/36 |
| 2018/0090077 | A1 * | 3/2018 | Zou | G09G 3/3406 |
| 2018/0336843 | A1 | 11/2018 | Xie et al. | |
| 2018/0373094 | A1 * | 12/2018 | Ryoo | G02F 1/133603 |
| 2019/0058244 | A1 | 2/2019 | Kim et al. | |
| 2019/0273497 | A1 | 9/2019 | Takeda et al. | |
| 2020/0103705 | A1 | 4/2020 | Chen et al. | |
| 2020/0245429 | A1 | 7/2020 | Sugimoto | |
| 2020/0267816 | A1 | 8/2020 | Nemati et al. | |
| 2020/0380925 | A1 | 12/2020 | Calayir et al. | |
| 2022/0043310 | A1 * | 2/2022 | Li | G02F 1/133612 |

FOREIGN PATENT DOCUMENTS

| | | | |
|---|---|---|---|
| CN | 110969976 | A | 4/2020 |
| CN | 108617055 | B | 7/2020 |
| CN | 110191539 | A | 9/2021 |
| JP | 5566920 | B2 | 8/2014 |
| JP | 5595941 | B2 | 9/2014 |

OTHER PUBLICATIONS

Doshi, M., et al., "Digital Architecture for Driving Large LED Arrays with Dynamic Bus Voltage Regulation and Phase Shifted PWM," APEC 07—Twenty-Second Annual IEEE Applied Power Electronics Conference and Exposition, 2007, pp. 287-293, doi: 10.1109/APEX.2007.357528.

Chen, W., "How to Apply Additional PWM Intensity Control to LED Drivers," Maxim Integrated Tutorials 4472, Jul. 2, 2010, https://www.maximintegrated.com/en/design/technical-documents/tutorials/4/4472.html.

* cited by examiner

CURRENT LOAD TRANSIENT MITIGATION IN DISPLAY BACKLIGHT DRIVER

CROSS-REFERENCE TO RELATED APPLICATIONS

This application claims priority to U.S. Provisional Application No. 63/245,613, filed Sep. 17, 2021, entitled "Current Load Transient Mitigation in Display Backlight Driver," the disclosure of which is incorporated by reference herein in its entirety for all purposes.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relates generally to systems and devices for reducing or preventing load fluctuations in a display to prevent undesirable audible noise, as well as improve electrical performance, backlight brightness accuracy, and power efficiency.

In particular, a processor of a driver of the display may determine a first pulse start time (e.g., a rise edge) for a first LED and a second pulse start time for a second LED. The processor may determine or receive a first pulse width for the first LED and a second pulse width for the second LED. The processor may also receive a gap clock having a specified number of gap clock units or positions. Additionally, the processor may determine a first pulse end time (e.g. a falling edge) for the first LED based at least in part on the first pulse start time, the first pulse width, and/or the gap clock. The processor may determine a second pulse end time for the second LED based at least in part on the first pulse end time, the second pulse start time, the second pulse width, the gap clock, or any combination thereof, in which the first pulse end time and the second pulse end time are different. The processor may instruct the driver to drive the first LED from the first pulse start time to the first pulse end time and the second LED from the second pulse start time to the second pulse end time. Specifically, the processor may determine a remainder of the first pulse width divided by the gap clock cycle, in which the remainder may be the position within the gap clock for placing the falling edge of the first pulse width.

For example, if the first pulse width is 45 units (e.g., seconds) and the gap clock has 8 gap clock units, the remainder is 5 units. The falling edge of the first pulse width will be placed at clock unit 5 of the gap clock of a gap clock cycle. By way of another example, the second pulse width, which is scheduled after completion of the first pulse width (e.g., after the falling edge), may have a pulse width such that the remainder is also 5 units. That is, both the first and second LEDs may have the same remainder and, as such, the same placements for the respective falling edges, resulting in the first and second LEDs turning off at the same time. Thus, the processor may implement a delay or advance (e.g., move or shift) the falling edge placement of the second pulse width by one or more specified gap clock units to prevent an overlap between the first and second pulse end times (e.g., the falling edges). In some embodiments, the specified gap clock units for moving the falling edge of the second pulse width is 2 gap clock units from the placement of the falling edge of the first pulse width. The specified gap clock units may include any number of gap clock units that reduce or eliminate load fluctuations (e.g., 2, 3, 6, etc.) (e.g., below a threshold load fluctuation). The threshold load fluctuation may be based on a maximum load fluctuation that is based on system acoustic noise requirements and how such fluctuation may impact system performance. By way of example, system performance may include signal integrity and/or system efficiency.

In additional or alternative embodiments, the processor may determine a starting edge separation based at least in part on the gap clock. The processor may schedule the second pulse start time from the first pulse start time based at least in part on the starting edge separation. In some embodiments, the starting edge separation may be one or more specified gap clock units (e.g., 10 gap clock units total) based at least in part on the gap clock cycle (e.g., 8 gap clock units in the gap clock cycle) and a number of buffer gap clock units (e.g., 2 gap clock units). In another embodiment, after determining the first pulse end time for the first LED and the second pulse end time for the second LED, the processor may instruct the driver to drive the first LED from the first pulse start time to the first pulse end time and the second LED from the second pulse start time to the second pulse end time by implementing the delay or advance in the center (e.g., middle) of the second pulse width. That is, rather than moving the falling edge of the second pulse width to delay the second pulse end time, the processor may add the delay or advance the center of the second pulse width to shift the width of the second pulse width. In this manner, the first and second pulse end times still do not overlap, reducing or preventing the possible load transient.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

Figure 1:
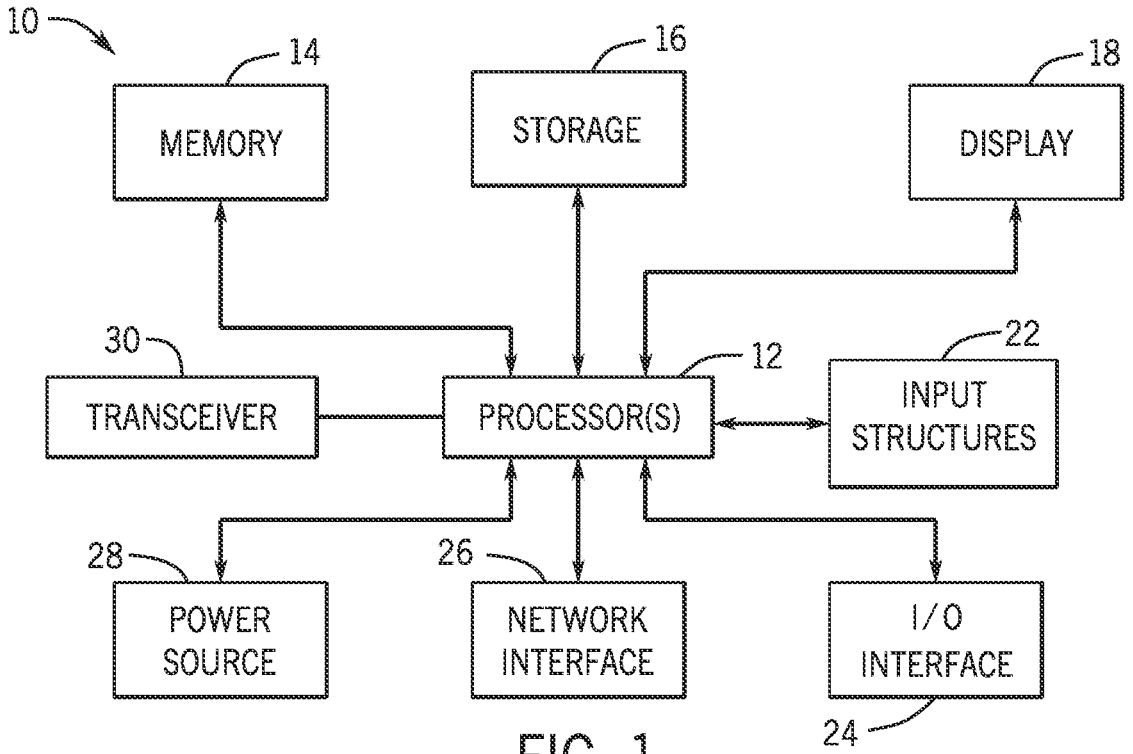
FIG. 1 is a block diagram of an electronic device, according to an embodiment of the present disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment", "an embodiment", or "some embodiments" of the present disclosure are not intended to be interpreted as excluding the existence of additional embodiments that also incorporate the recited features. Use of the term "approximately" or "near" should be understood to mean including close to a target (e.g., design, value, amount), such as within a margin of any suitable or contemplatable error (e.g., within 0.1% of a target, within 1% of a target, within 5% of a target, within 10% of a target, within 25% of a target, and so on). As used herein, a "load profile" refers to a variation in electrical load versus time. The load profile may indicate the amount of power to be used at a given time, for example, for driving one or more light emitting diodes (LEDs) of a display. A "virus pattern" refers to a pattern of load profiles for LEDs or zones of LEDs that result in an unexpected load fluctuation (e.g., load transient). As will be described herein, multiple LEDs turning on or off at the same or approximately the same time may result in the load transient. By way example, a backlight system of the display may provide light in two dimensions (e.g., a 2D backlight) that is divided into spatial zones associated with different light emitting diodes (LEDs). A driver of a zone may drive each of the LEDs in the zone. Multiple zones of LEDs turning on or off at the same time may create pattern of multiple load profiles (e.g., the virus pattern) that results in the load transient. At a low enough frequency, the load transient may result in perceivable audible noise, as well as reduce electrical performance, backlight brightness accuracy, and power efficiency.

The present disclosure provides techniques for reducing or removing the virus pattern resulting in the load transient. In this manner, the techniques described herein may also reduce or eliminate the perceivable audible noise. In particular, and as previously mentioned, some electronic displays, such as light emitting diode (LED) displays, organic light emitting diode (OLED), and/or micro light emitting diode (μ-LED) displays, or liquid crystal displays (LCDs) with a backlight (e.g., a 0-dimensional backlight, 1-dimensional backlight, a 2-dimensional backlight) may include LEDs that turn on or off at approximately the same time. A driver may drive one or more of the LEDs. In some instances, the one or more LEDs may be organized by zones of a backlight system of a display, such that one driver drives the LEDs of a zone (e.g., four LEDs to a zone). As such, the driver may determine the pulse widths (e.g., receive data indicating the pulse widths) for driving each of the LEDs to the desired brightness level (or, in some cases, gray level). The brightness level value may include a range of values in binary format (e.g., bit value or a byte), corresponding to an amount of luminance to facilitate in displaying an image on the electronic display. As such, the pulse widths for each of the LEDs may vary to emit different brightness levels.

The driver may drive the LEDs sequentially and/or simultaneously. However, and as previously mentioned, multiple LEDs simultaneously turning on, such as the LEDs of one or more zones, may result in an overshoot at an output of a power source used for turning on the LEDs. Similarly, multiple LEDs simultaneously turning off may result in an undershoot at the output of the power source. The overshoot and undershoot may cause an unexpected load variation (e.g., load transient) at the power source. The load variation may result in perceivable audible noise, as previously mentioned. The load variation may also result in other unexpected variations in system performance, such as unexpected changes to signal integrity, brightness accuracy, and system efficiency.

As described herein, the driver may determine a relationship between the received pulse widths for driving the LEDs within a zone and the gap clock. For example, based on first start and end pulse times of a first pulse width relative to the gap clock for a first LED, the driver may determine whether second start and end pulse time for a second pulse width of a second LED may overlap with the first LED. The driver may strategically implement a delay or advance to the second pulse width to shift the second start and end pulse times of the second pulse width so that the first and second pulse start and/or pulse end times do not overlap. That is, the driver may delay driving the second LED to prevent the LEDs from turning on at the same time to prevent the load variation. Accordingly, precisely scheduling the start and/or end pulse times to avoid the LEDs from turning on or off at the same time, may reduce or prevent the load variation.

With the foregoing in mind, FIG. 1 illustrates an electronic device 10 according to an embodiment of the present disclosure may include, among other things, one or more processor(s) 12, memory 14, nonvolatile storage 16, a display 18, input structures 22, an input/output (I/O) interface 24, a network interface 26, a power source 28, and a transceiver 30. The various functional blocks shown in FIG. 1 may include hardware elements (including circuitry), software elements (including computer code stored on a computer-readable medium) or a combination of both hardware and software elements. It should be noted that FIG. 1 is merely one example of a particular implementation and is intended to illustrate the types of components that may be present in electronic device 10.

Figure 2:
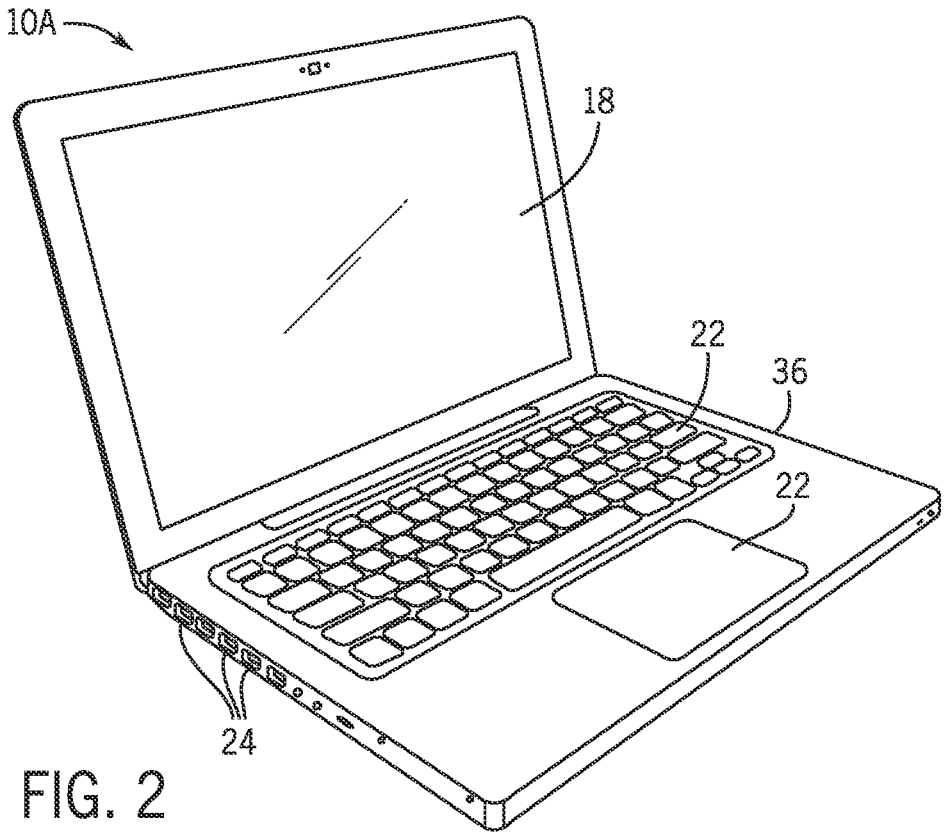
FIG. 2 is a perspective view of a notebook computer representing an embodiment of the electronic device of FIG. 1.
Figure 4:
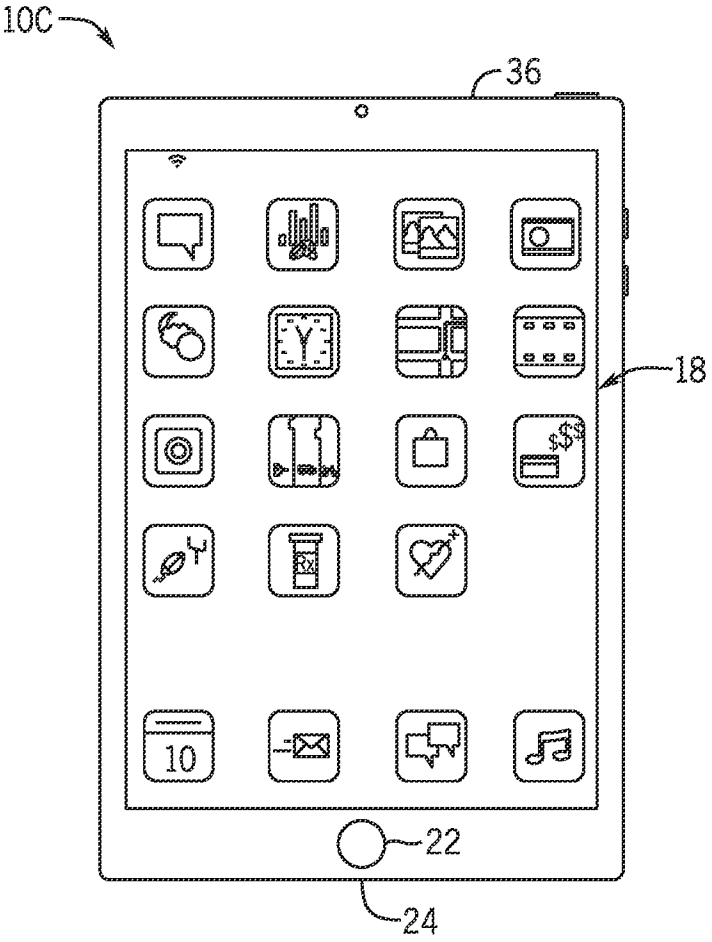
FIG. 4 is a front view of another handheld device representing another embodiment of the electronic device of FIG. 1.
Figure 3:
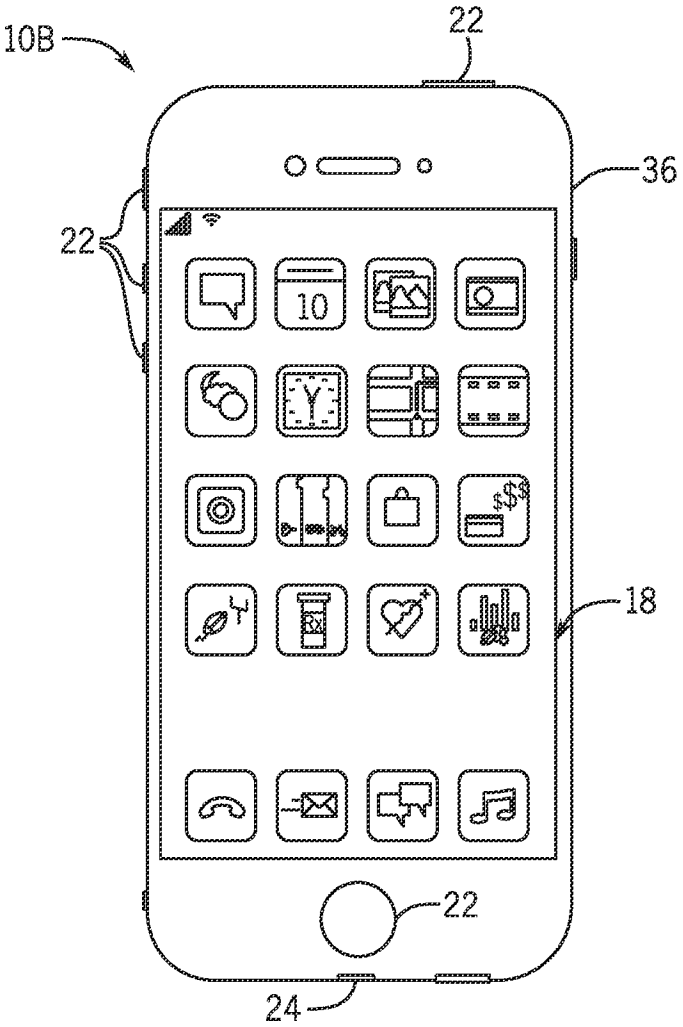
FIG. 3 is a front view of a handheld device representing another embodiment of the electronic device of FIG. 1.
Figure 5:
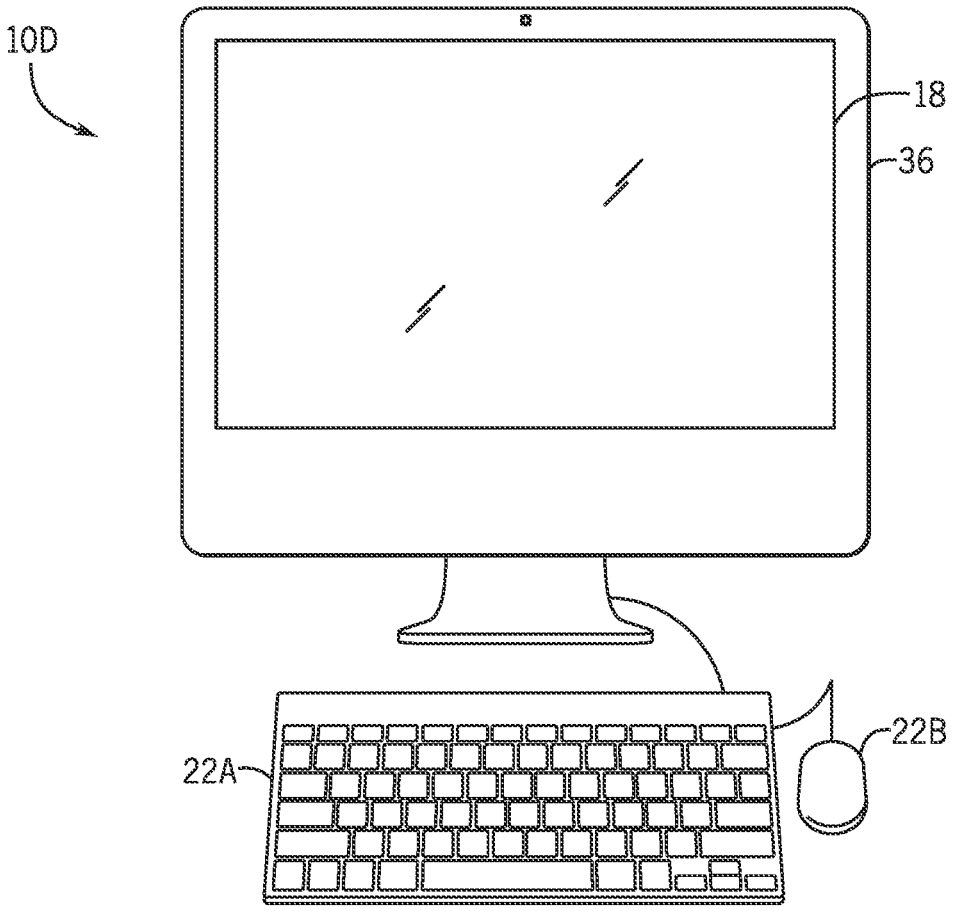
FIG. 5 is a front view of a desktop computer representing another embodiment of the electronic device of FIG. 1.
Figure 6:
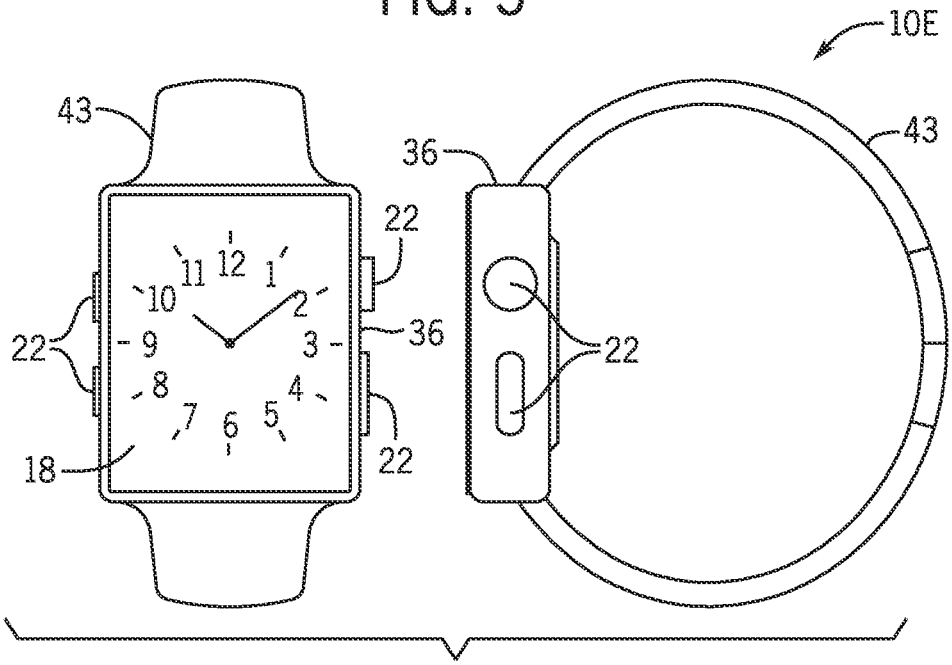
FIG. 6 is a front view and side view of a wearable electronic device representing another embodiment of the electronic device of FIG. 1.

By way of example, the electronic device 10 may represent a block diagram of the notebook computer depicted in FIG. 2, the handheld device depicted in FIG. 3, the handheld device depicted in FIG. 4, the desktop computer depicted in FIG. 5, the wearable electronic device depicted in FIG. 6, or similar devices. It should be noted that the processor(s) 12 and other related items in FIG. 1 may be generally referred to herein as "data processing circuitry." Such data processing circuitry may be embodied wholly or in part as software, hardware, or any combination thereof. Furthermore, the processor(s) 12 and other related items in FIG. 1 may be a single contained processing module or may be incorporated wholly or partially within any of the other elements within the electronic device 10.

In the electronic device 10 of FIG. 1, the processor(s) 12 may be operably coupled with a memory 14 and a nonvolatile storage 16 to perform various algorithms. For example, the algorithms may include ones for efficiently shifting the pulse width for driving LEDs to prevent load fluctuations. Such algorithms or instructions executed by the processor(s) 12 may be stored in any suitable article of manufacture that includes one or more tangible, computer-readable media. The tangible, computer-readable media may include the memory 14 and/or the nonvolatile storage 16, individually or collectively, to store the algorithms or instructions. The memory 14 and the nonvolatile storage 16 may include any suitable articles of manufacture for storing data and executable instructions, such as random-access memory, read-only memory, rewritable flash memory, hard drives, and optical discs. In addition, programs (e.g., an operating system) encoded on such a computer program product may also include instructions that may be executed by the processor(s) 12 to enable the electronic device 10 to provide various functionalities.

In certain embodiments, the display 18 may be a liquid crystal display (LCD), which may display images using liquid crystal pixels illuminated by a backlight. The backlight may be 0-dimensional (all pixels receive the same level of illumination from the backlight), 1-dimensional (pixels in one direction may receive the same level of illumination from the backlight while the level of illumination may vary), or 2-dimensional (pixels in different x or y directions may receive different illumination from the backlight). In the case of a 2-dimensional backlight, some regions of the display may be significantly brighter than other regions, which may particularly support high dynamic range (HDR) content. In some embodiments, the display 18 may include a touch screen, which may facilitate user interaction with a user interface of the electronic device 10. Furthermore, it should be appreciated that, in some embodiments, the display 18 may be a light-emitting diode (LED) display, organic light-emitting diode (OLED) display, μ-LED display, active-matrix organic light-emitting diode (AMOLED) display, or some combination of these and/or other display technologies.

In some instances, the display 18 may include drivers that drive multiple LEDs at the same or approximately the same time, resulting in a large load variation at an output of the power source for the display 18. As will be described herein, to prevent the large load variation at the output of the power source, drivers of the display 18 that control respective sets of LEDs may schedule different rising edge times for the LEDs (e.g., turn on the LEDs at different times). In this manner, the drivers may prevent the respective sets of the LEDs from turning on at the same time. Moreover, by changing the rising edge times, the falling edge times may also change so that the LEDs do not turn off at the same time, preventing an unexpected load variation.

The input structures 22 of the electronic device 10 may enable a user to interact with the electronic device 10 (e.g., pressing a button to increase or decrease a volume level). The I/O interface 24 may enable the electronic device 10 to interface with various other electronic devices, as may the network interface 26. The network interface 26 may include, for example, one or more interfaces for a personal area network (PAN), such as a BLUETOOTH® network, for a local area network (LAN) or wireless local area network (WLAN), such as an 802.11x WI-FI® network, and/or for a wide area network (WAN), such as a $3^{rd}$ generation (3G) cellular network, universal mobile telecommunication system (UMTS), $4^{th}$ generation (4G) cellular network, long term evolution (LTE®) cellular network, long term evolution license assisted access (LTE-LAA) cellular network, $5^{th}$ generation (5G) cellular network, and/or New Radio (NR) cellular network. In particular, the network interface 26 may include, for example, one or more interfaces for using a Release-15 cellular communication standard of the 5G specifications that include the millimeter wave (mmWave) frequency range (e.g., 24-300 GHz). The transceiver 30 of the electronic device 10, which includes the transmitter and the receiver, may allow communication over the aforementioned networks (e.g., 5G, Wi-Fi, LTE-LAA, and so forth).

The network interface 26 may also include one or more interfaces for, for example, broadband fixed wireless access networks (e.g., WIMAX®), mobile broadband Wireless networks (mobile WIMAX®), asynchronous digital subscriber lines (e.g., ADSL, VDSL), digital video broadcasting-terrestrial (DVB-T®) network and its extension DVB Handheld (DVB-H®) network, ultra-wideband (UWB) network, alternating current (AC) power lines, and so forth.

In some embodiments, the electronic device 10 communicates over the aforementioned wireless networks (e.g., WI-FI®, WIMAX®, mobile WIMAX®, 4G, LTE®, 5G, and so forth) using the transceiver 30. The transceiver 30 may include circuitry useful in both wirelessly receiving the reception signals at the receiver and wirelessly transmitting the transmission signals from the transmitter (e.g., data signals, wireless data signals, wireless carrier signals, radio frequency signals). Indeed, in some embodiments, the transceiver 30 may include the transmitter and the receiver combined into a single unit, or, in other embodiments, the transceiver 30 may include the transmitter separate from the receiver. The transceiver 30 may transmit and receive radio frequency signals to support voice and/or data communication in wireless applications such as, for example, PAN networks (e.g., BLUETOOTH®), WLAN networks (e.g., 802.11x WI-FI®)), WAN networks (e.g., 3G, 4G, 5G, NR, and LTE® and LTE-LAA cellular networks), WIMAX® networks, mobile WIMAX® networks, ADSL and VDSL networks, DVB-T® and DVB-H® networks, UWB networks, and so forth. As further illustrated, the electronic device 10 may include the power source 28. The power source 28 may include any suitable source of power, such as a rechargeable lithium polymer (Li-poly) battery and/or an alternating current (AC) power converter.

In certain embodiments, the electronic device 10 may take the form of a computer, a portable electronic device, a wearable electronic device, or other type of electronic device. Such computers may be generally portable (such as laptop, notebook, and tablet computers), or generally used in one place (such as desktop computers, workstations, and/or servers). In certain embodiments, the electronic device 10 in the form of a computer may be a model of a MacBook®, MacBook® Pro, MacBook Air®, iMac®, Mac® mini, or Mac Pro® available from Apple Inc. of Cupertino, California By way of example, the electronic device 10, taking the form of a notebook computer 10A, is illustrated in FIG. 2 in accordance with one embodiment of the present disclosure. The depicted notebook computer 10A may include a housing or enclosure 36, a display 18, input structures 22, and ports of an I/O interface 24. In one embodiment, the input structures 22 (such as a keyboard and/or touchpad) may be used to interact with the computer 10A, such as to start, control, or operate a graphical user interface (GUI) and/or applications running on computer 10A. For example, a keyboard and/or touchpad may allow a user to navigate a user interface and/or an application interface displayed on display 18.

FIG. 3 depicts a front view of a handheld device 10B, which represents one embodiment of the electronic device 10. The handheld device 10B may represent, for example, a portable phone, a media player, a personal data organizer, a handheld game platform, or any combination of such devices. By way of example, the handheld device 10B may be a model of an iPhone® available from Apple Inc. of Cupertino, California. The handheld device 10B may include an enclosure 36 to protect interior components from physical damage and/or to shield them from electromagnetic interference. The enclosure 36 may surround the display 18. The I/O interfaces 24 may open through the enclosure 36 and may include, for example, an I/O port for a hardwired connection for charging and/or content manipulation using a connector such as the Lightning connector provided by Apple Inc. of Cupertino, California, a universal serial bus (USB), or other similar connector and protocol.

The input structures 22, in combination with the display 18, may allow a user to control the handheld device 10B. For example, the input structures 22 may activate or deactivate the handheld device 10B, navigate user interface to a home screen, a user-configurable application screen, and/or activate a voice-recognition feature of the handheld device 10B. Other input structures 22 may provide volume control, or may toggle between vibrate and ring modes. The input structures 22 may also include a microphone that may obtain a user's voice for various voice-related features, and a speaker that may enable audio playback and/or certain phone capabilities. The input structures 22 may also include a headphone input that may provide a connection to external speakers and/or headphones.

FIG. 4 depicts a front view of another handheld device 10C, which represents another embodiment of the electronic device 10. The handheld device 10C may represent, for example, a tablet computer, or one of various portable computing devices. By way of example, the handheld device 10C may be a tablet-sized embodiment of the electronic device 10, which may be, for example, a model of an iPad® available from Apple Inc. of Cupertino, California.

Turning to FIG. 5, a computer 10D may represent another embodiment of the electronic device 10 of FIG. 1. The computer 10D may be any computer, such as a desktop computer, a server, or a notebook computer, but may also be a standalone media player or video gaming machine. By way of example, the computer 10D may be an iMac®, a MacBook®, or other similar device by Apple Inc. of Cupertino, California. It should be noted that the computer 10D may also represent a personal computer (PC) by another manufacturer. A similar enclosure 36 may be provided to protect and enclose internal components of the computer 10D, such as the display 18. In certain embodiments, a user of the computer 10D may interact with the computer 10D using various peripheral input structures 22, such as the keyboard 22A or mouse 22B (e.g., input structures 22), which may connect to the computer 10D.

Similarly, FIG. 6 depicts a wearable electronic device 10E representing another embodiment of the electronic device 10 of FIG. 1 that may be configured to operate using the techniques described herein. By way of example, the wearable electronic device 10E, which may include a wristband 43, may be an Apple Watch® by Apple Inc. of Cupertino, California. However, in other embodiments, the wearable electronic device 10E may include any wearable electronic device such as, for example, a wearable exercise monitoring device (e.g., pedometer, accelerometer, heart rate monitor), or other device by another manufacturer. The display 18 of the wearable electronic device 10E may include a touch screen display 18 (e.g., LCD, LED display, OLED display, μ-LED display, active-matrix organic light emitting diode (AMOLED) display, and so forth), as well as input structures 22, which may allow users to interact with a user interface of the wearable electronic device 10E.

Figure 7:
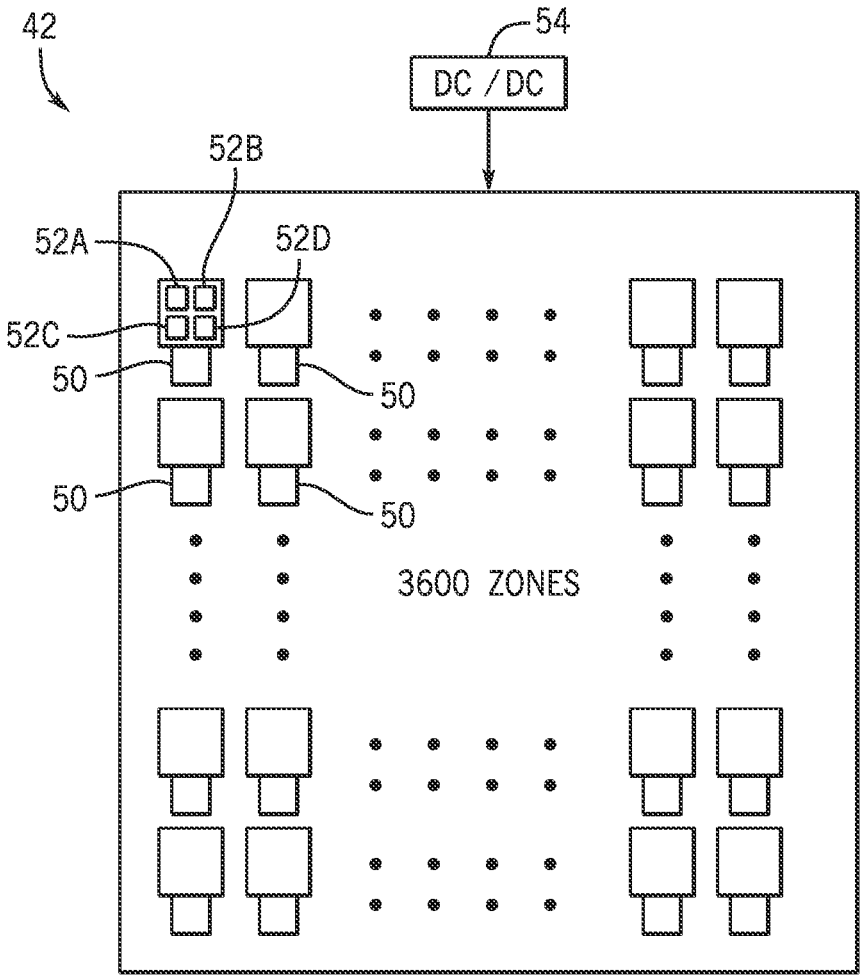
FIG. 7 is a front view of a backlight system of a display of the electronic device of FIG. 1, according to embodiments of the present disclosure.

With the foregoing in mind, FIG. 7 is a front view of a backlight system 42 of a display 18 of the electronic device of FIG. 1. The backlight system 42 may connect to a voltage source 54 (e.g., power source 28) that provides power to the backlight system 42. Specifically, the voltage source 54 may provide power to one or more light emitting diode (LED) drivers 50 to drive one or more respective LEDs 52. The drivers 50 may drive one or more LED 52 organized by a zone (as indicated by the box around the LEDs 52) of the backlight system 42. In some embodiments, the LEDs 52 may be two-dimension (2D) LEDs that emit lights in two dimensions (e.g., varying the amount of light in both vertical and horizontal dimensions of the electronic display 18). In other embodiments, the LEDs 52 may be one-dimensional (e.g., varying along just one of the vertical or horizontal dimensions) or may provide a uniform amount of light across the display 18. The backlight system 42 in the depicted embodiment may include between forty and fifty rows of 2D LEDs 52 and between eighty and one hundred columns of LEDs 52 (e.g., forty five rows and eighty columns). However, the techniques described herein may apply to an array of M rows×N columns of LEDs 52 (e.g., one or more rows by one or more columns of LEDs 52). Similarly, although the depicted backlight system 42 includes 3600 zones that each include a driver 50 driving four LEDs 52, the techniques described herein may apply to one or more zones that each include one or more drivers 50 driving one or more respective LEDs 52.

In some instances, the drivers 50 of the multiple zones may drive respective LEDs 52 at the same or approximately the same time. That is, the LEDs 52 of more than one of the zones may turn on at the same time, causing LEDs 52 to emit light at the same time. As previously discussed, a "load profile" may refer to a variation in electrical load versus time. The load profile may indicate how much power will be used at a given time. Thus, the voltage source 54 may transmit current to the drivers 50 based on the load profiles corresponding to respective zones. However, a pattern of load profiles of LEDs 52, such as load profiles corresponding to each of the zones, may result in an unexpected load transient and create a virus pattern. For example, the pattern of load profiles may cause the respective LEDs 52 in the zones to turning on or off at the same or approximately the same, causing an unexpected load transient.

In particular, the LEDs 52 of the multiple zones turning on or emitting light at the same time (e.g., driven by respective drivers 50) may cause an overshoot or a spike at the output of the voltage source 54. Similarly, the LEDs 52 of the multiple zones turning off or no longer emitting light at the same time (e.g., no longer driven by respective drivers 50 and/or with the same power level) may cause an undershoot or a valley at the output of the voltage source 54. The overshoot or undershoot may result in unexpected load to be powered by the voltage source 54, causing an unexpected audible noise, such as an electromagnetically induced acoustic noise. In particular, when the voltage/current waveforms of capacitors of the backlight system 42 are not constant and contain time harmonics (e.g., at a particular frequency, such as 2 kilohertz (kHz)), such harmonics may generate acoustic noise. In some instances, the overshoot or undershoot may also result in unexpected perceivable artifacts on the display 18. The overshoot or undershoot ripple may also result in other unexpected variations in system performance, including but not limited to, signal integrity (e.g., decreased signal integrity) and/or power (e.g., power loss due to need for higher supply voltage when the ripple is large).

To reduce or mitigate the noise, and as discussed in detail with respect to FIG. 8-11, the processor 12 may precisely determine a first pulse start time and a first pulse end time for a LED 52 based on a gap clock, and determine a second pulse start time with a delay or advance in time based on the gap clock. The gap clock may include a clock cycle used to track a start and an end time of a known pulse width for the driver 50 driving a particular LED 52 (e.g., microdriver driving a micro light emitting diode (μ-LED)). In this manner, the driver 50 (e.g., a processor of the driver 50) may determine a relationship between the start and end pulse times of one or more additional pulses for driving other LEDs 52 driven by the driver 50, based on the respective pulse widths. The driver 50 may be directly connected to the LEDs 52 and may determine the relationship and non-overlapping start and/or end pulse times for the LEDs 52. Since the driver 50 makes these determinations, rather than a device external to the zone or LEDs 52 (e.g., not directly connected or coupled, or that includes additional circuitry between the device and the LEDs 52), the driver 50 may use less processing power and/or processing time for making the determinations. Moreover, since the driver 50 may determine the start and end pulse times based on the pulse width relative to the gap clock and determine additional start and end pulse times for additional pulse widths associated with driving the other LEDs 52, the systems and methods described herein may reduce and/or eliminate the need to store the start and end pulse times in memory 14.

Moreover, and as previously discussed, load profiles for the one or more LEDs 52 (e.g., within a zone) may simultaneously cause the LEDs 52 to turn on or off at the same or approximately the same time, resulting in a load transient (e.g., fluctuation or variation) at the output of the voltage source 54. As previously mentioned, a driver 50 driving LEDs 52 may determine a precise start and end pulse timing for driving each of the LEDs 52 based on the respective pulse widths and the gap clock.

Figure 8:
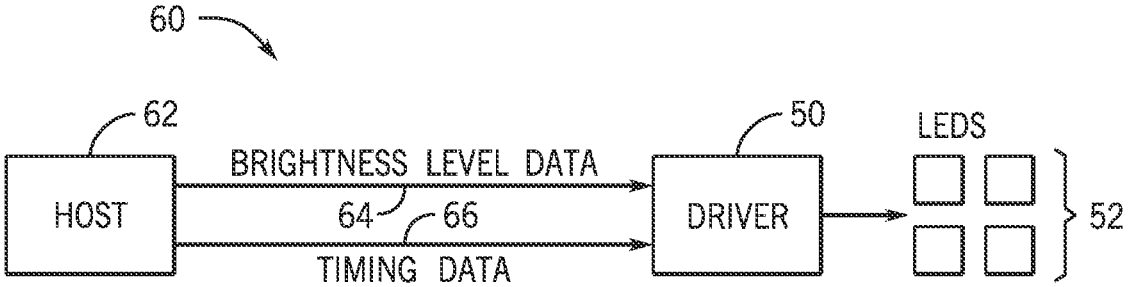
FIG. 8 is a flow chart of data flow for mitigating a load fluctuation in the backlight system, according to embodiments of the present disclosure.

To illustrate, FIG. 8 is flow chart of data flow 60 for mitigating a load fluctuation in the backlight system 42. As shown, the data flow 60 may involve a host 62, a driver 50, and one or more LEDs 52. Although the following descriptions describe the driver 50 driving four LEDs 52 of a single zone, which represents a particular embodiment, the systems and methods described herein may include a driver 50 that drives one or more LEDs 52 (e.g., one, three, four, six, seven, etc.) of one or more zones.

The host 62 may include an internal or external device that may provide image related data to the driver 50 to drive the LEDs 52. For example, the host 62 may provide a brightness level data 64 (e.g., based on gray levels in a zone) for the LEDs 52 being driven. Specifically, the image data may indicate a gray level (e.g., brightness level) value that is represented and stored in a binary format. The gray level value may include a range of values from 0 to 255 in a binary format (e.g., bit value or a byte), corresponding to an amount of luminance to facilitate in displaying an image on the electronic display 18. A gray level value of 0 may refer to no luminance while a gray level value of 255 may correspond to a highest possible luminance. Values in between may make up different shades of gray. By way of example, the brightness level data 64 for an LED 52 and the respective pulse width may be positively and/or linearly correlated. That is, the driver 50 may drive an LED 52 to for a long pulse width to emit a high brightness level than for a relatively lower brightness level.

The host 62 may also provide timing data 66 indicating pulse widths for each of the respective LEDs 52. The pulse width may include an elapsed time between the rising edge (e.g., a clock/logic high) and a falling edge (e.g., a clock/logic low) of a single pulse for driving an LED 52. The timing data 66 may also include the gap clock. The gap clock may include a clock used to track and determine a relationship between the pulse widths. That is, the pulse widths may be measured or tracked relative to the gap clock. The gap clock may include a time period of a number of clock positions or units, such as 2, 6, 8, 10, and so forth, gap clock units.

After the driver 50 receives the brightness level data 64 and the timing data 66 for the LEDs 52 driven by the driver 50 (e.g., LEDs of a zone associated with the driver 50), the driver 50 may determine start and end pulse times for each of the pulse widths so that driver 50 does not drive the LEDs 52 at the same or approximately the same time. By precisely starting the pulse widths at non-overlapping units of the gap clock, the driver 50 may reduce or prevent a load transient at the backlight system 42.

Figure 9:
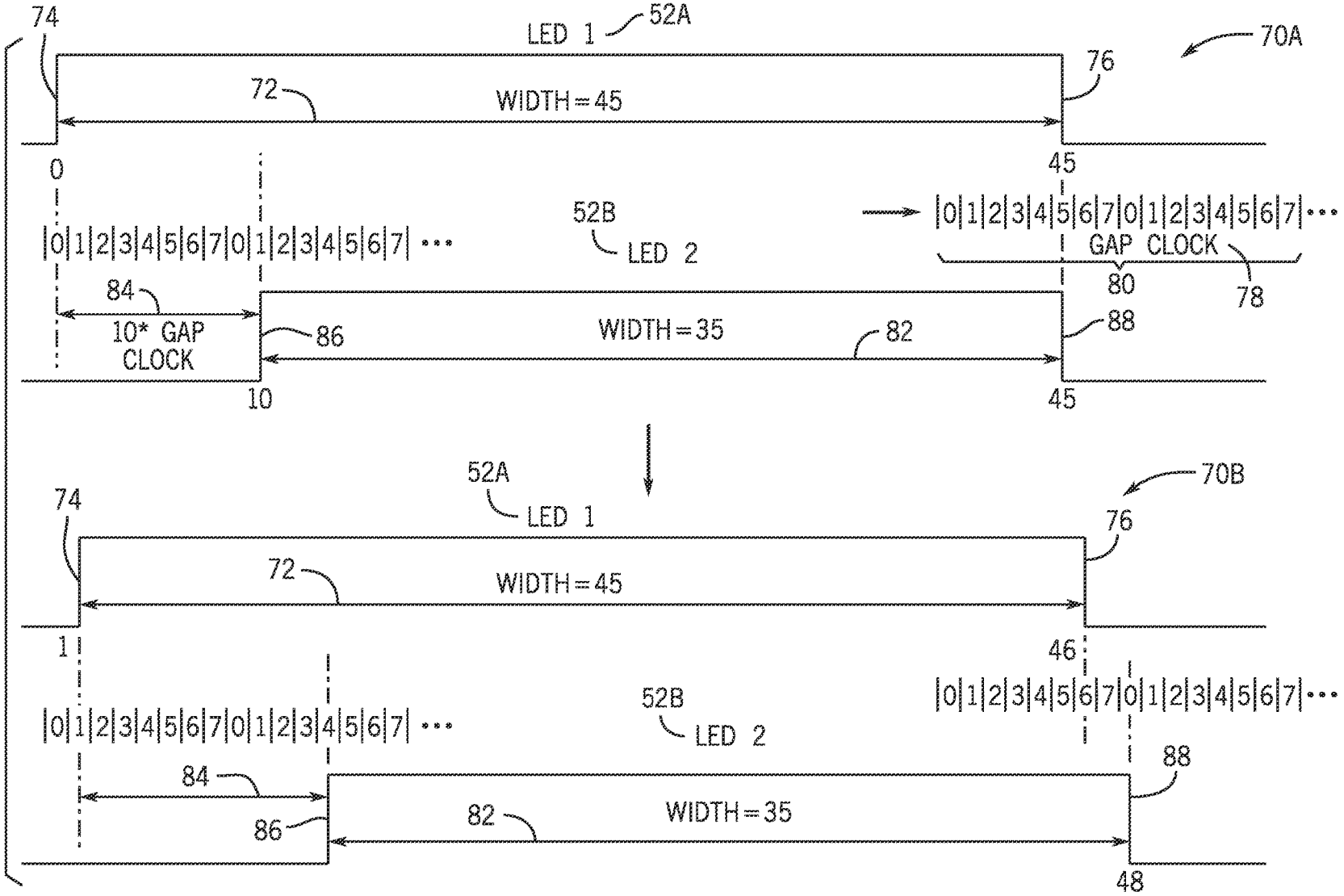
FIG. 9 is a timing diagram for extending a pulse width to prevent the load fluctuation, according to embodiments of the present disclosure.

To illustrate, FIG. 9 depicts a timing diagram 70 shifting a pulse width start or end time to prevent a load fluctuation (e.g., load transient). A first timing diagram 70A depicts a first pulse width 72 associated with a first LED 52A (LED 1) and a second pulse width 82 associated with a second LED 52B (LED 2). The first pulse width has a width of 45 clock units and the second pulse width 82 has a width of 35 clock units. The timing diagram 70 may be described with respect to a gap clock 78. In the depicted embodiment, the gap clock 78 has a cycle of 8 clock units or positions 80 (e.g., 0 through 7) that repeats upon completion of a cycle. Although the systems and methods described herein use a gap clock 78 with 8 gap clock positions 80, the gap clock 78 may have two or more gap clock positions 80 (e.g., 2, 4, 5, 6, 10, 20, etc., gap clock units).

The first pulse width 72 has a first pulse start time at a first rising edge 74, which starts at 0 gap clock position of the gap clock 78. As mentioned with respect to FIG. 8, the driver 50 may determine a first pulse start time and a first pulse end time based on the first pulse width 72 and the gap clock 78. The driver 50 may subsequently determine pulse starts and end times for additional LEDs 52 driven by the driver 50. By way of example, the driver 50 may determine the first pulse start time for the first LED 52A based on the gap clock position 80, such as to start at the 0 gap clock position of the gap clock 78. To determine the first pulse end time, the driver 50 may divide the first pulse width 72 by the gap clock 78 to determine a remainder as placement for the falling edge 46 the first pulse width 72 within a gap clock cycle. Here, the first pulse width 72 is 45 gap clock positions 80 and the gap clock 78 has a cycle of 8 gap clock positions 80, and thus, the remainder is 5. As such, the first falling edge 46 of the first pulse width 72 may be placed at the position 5 of the gap clock 78.

The driver 50 may precisely determine and schedule a second rising edge 86 for the second LED 52B after determining the first falling edge 76. As shown in the first timing diagram 70A, the second pulse width 82 of the second LED 52B is 35 clock units. In some embodiments, as shown, the driver 50 may also apply a starting edge separation 84, which may be based on the gap clock 78. That is, the driver 50 may schedule the second rising edge 86 for the second pulse start time from the first rising edge 74 for the first pulse start time, based on the starting edge separation 84. In some embodiments, the starting edge separation 84 may be specified gap clock positions 80 based at least in part on the gap clock 78 and a buffer number of gap clock positions (e.g., 10 gap clock positions total). For example, the buffer number of may be 2 gap clock positions 80 and the gap clock 78 may include 8 gap clock positions 80, a previously discussed, and thus, the starting edge separation 84 may be a total of 10 gap clock positions 80.

Since the driver 50 schedules the second rising edge 86 of the second pulse start time with the starting edge separation (e.g., 10 gap clock positions 80) and the second pulse width 82 is 35 units, the remainder is also 5 (e.g., (width of 35 clock units+10 gap clock units) divided by 8 gap clock units of the cycle)). That is, both the first falling edge 76 of the first LED 52A and the second falling edge 88 of the second LED 52B may be placed at unit 5 of the cycle of the gap clock 78. Thus, the first LED 52A and the second LED 52B may turn off at the same time. However, as previously mentioned, the driver 50 may precisely determine the second rising edge 86 of the second pulse start time and/or the second falling edge 88 of the second pulse end time, such that the first falling edge 76 and the second falling edge 88 do not overlap, preventing a load transient.

As shown in a second timing diagram 70B, the driver 50 may implement a delay or advance the placement of the second falling edge 88, moving the second pulse end time by a specified number of gap clock positions 80 (e.g., 1, 2, 5, 6, 7, 17, etc.). The specified number of gap clock positions 80 may include a number of units that efficiently reduces or prevents a possible load fluctuation. In some embodiments, the specified number of gap clock position 80 to implement the delay or advance may include shifting a rising or falling edge by −2 or +2 gap clock position 80. Additionally or alternatively, the specified number of gap clock position 80 may preclude gap clock positions 80 that result in adjacent placement. For example, if the first falling edge 76 is placed at 1 gap clock position of the gap clock 78, then the specified number of gap clock units 80 may not include units that result in the second falling edge 88 being placed at either 0 or 2 gap clock positions (e.g., adjacent to 1 gap clock position) of the gap clock 78.

To implement the delay or advance the placement of the falling edge, the driver 50 may add the delay at a first rising edge. Here, the driver 50 implements a delay at the first rising edge 74 of 1 gap clock position 80, such that the first rising edge 74 starts at 1 instead of at 0 gap clock position of a first cycle of the gap clock 78, and the first falling edge 76 is placed at 6 gap clock position of the gap clock 78 instead of at 5 gap clock position (e.g., pulse width 72 delayed by 1 gap clock position 80). That is, the driver 50 shifts the first rising edge 74 and/or the first falling edge 76 of the first pulse width 72 and/or the second pulse width 82 by the specified number of gap clock positions 80 to prevent overlapping rising edges or falling edges that may otherwise result in a load overshoot or undershoot. In the depicted embodiment, the specified gap clock positions 80 for moving the second falling edge 88 is 2 gap clock units 80 from the placement of the first falling edge 76, resulting in a delay of 3 gap clock positions 80 (e.g., since the first rising edge 74 was shifted by 1 gap clock position) from the placement of the second falling edge 88 in the first timing diagram 70A. In either example, by driving the first LED 52A and the second LED 52B with different pulse end times by applying a delay of gap clock positions 80 to the rising edges 74, 86 to effectively implement the delay the falling edges 76, 88, the LEDs 52 may not turn off at the same time and prevent the large load transient.

Figure 10:
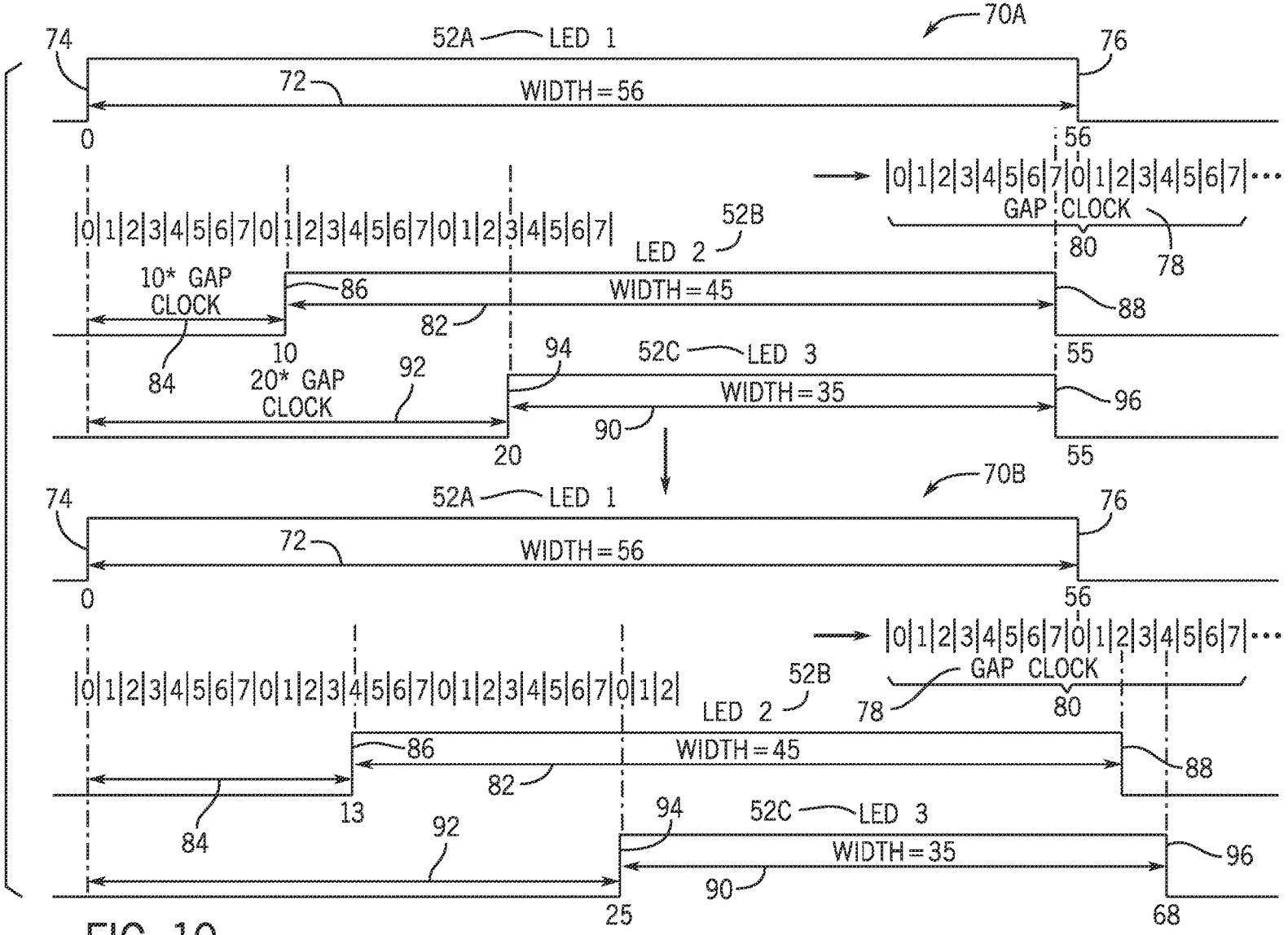
FIG. 10 is a timing diagram for extending a pulse width to prevent the load fluctuation that uses a starting edge separation, according to embodiments of the present disclosure.

FIG. 10 is a timing diagram 70 of the pulse widths with starting edge separations 84. As shown in the first timing diagram 70A, the first LED 52A may be driven for a first pulse width 72 of 56 clock units. The first rising edge 74 may be placed at 0 gap clock position of the gap clock 78. Since the gap clock 78 has 8 gap clock positions 80, the driver 50 may calculate a remainder of 0 (e.g., pulse width 56 clock units divided by 8 gap clock units of gap clock) for the placement of the first falling edge 76. In some embodiments, a host device (e.g., the electronic device 10) may calculate offsets and dynamically change pulse locations. Often, the driver 50 may calculate the pulse width, as well as change pulse locations, to increase system efficiency (e.g., avoid time otherwise used to communicate between the host device and the driver 50). The second LED 52B may be driven for a second pulse width of 45 clock units. The driver 50 may schedule the second rising edge 86 of the second pulse start time with the starting edge separation 84 of 10 gap clock positions 80, as previously discussed. Thus, the remainder is 7 (e.g., 55 gap clock positions (pulse width of 45 clock units+10 gap clock units) divided by 8 gap clock units of the cycle)). As previously mentioned, the driver 50 may preclude falling and rising edges within one gap clock position (e.g., +1 or −1 gap clock positions 80). That is, since the first falling edge 76 is placed at 0 gap clock position of the gap clock unit 78, the driver 50 may not place the second falling edge 76 at 7 gap clock position (e.g., 1 gap clock position apart from 0 gap clock position in the gap clock cycle). As shown in the second timing diagram 70B, the driver 50 may implement a specified gap clock units delay of 3 gap clock units, such that the second rising edge 86 is placed at 4 instead of at 1, increasing the starting edge separation to 13 gap clock units 80.

Referring back to the first timing diagram 70A, a third LED 52C is driven by the driver 50 for a third pulse width 90 of 35 clock units. A third rising edge 94 may be delayed by a second starting edge separation 92. As previously discussed, the second starting edge separation 92 may include a specified number of gap clock positions 80, for example, to reduce a likelihood of overlapping edges of the pulse widths that result in load fluctuations. Here, the second starting edge separation 92 is 20 gap clock positions (e.g., twice the starting edge separation 84 applied to the second rising edge 86), resulting in the second rising edge 86 placed at 3 gap clock position of the gap clock 78. Moreover, the remainder is also 7 (e.g., 55 clock units (pulse width of 35 clock units+20 gap clock units) divided by 8 gap clock units of the cycle) for placing a third falling edge 96, and thus, the second falling edge 88 of the second pulse width 82 and the third falling edge 96 of the third pulse width 90 may overlap.

As shown in the second timing diagram 70B, to prevent the overlap, the driver 50 may apply another delay or advance of specified gap clock positions (e.g., +2 or −2 positions or more). Here, the driver 50 applies a delay of 5 to the third rising edge 94 to delay the pulse start time and effectively delay the pulse end time. The specified delay may include or consider delays applied to previous rising edges (e.g., the second rising edge 86 to effectively delay the second falling edge 88) in addition to the delay for the third rising edge 94. In some embodiments, the driver 50 may implement the delay or advance in the center (e.g., middle) of a pulse width. That is, rather than moving the placement of a rising edge of a pulse width to effectively change the falling edge of the pulse end time, the driver 50 may add the delay or advance at the center of the pulse width to change the placement of the pulse width at the gap clock positions 80 of the gap clock 78. In this manner, the rising edges and/or the falling edges of the pulse start time and/or pulse end times still may not overlap, preventing the possible load variations.

Figure 11:
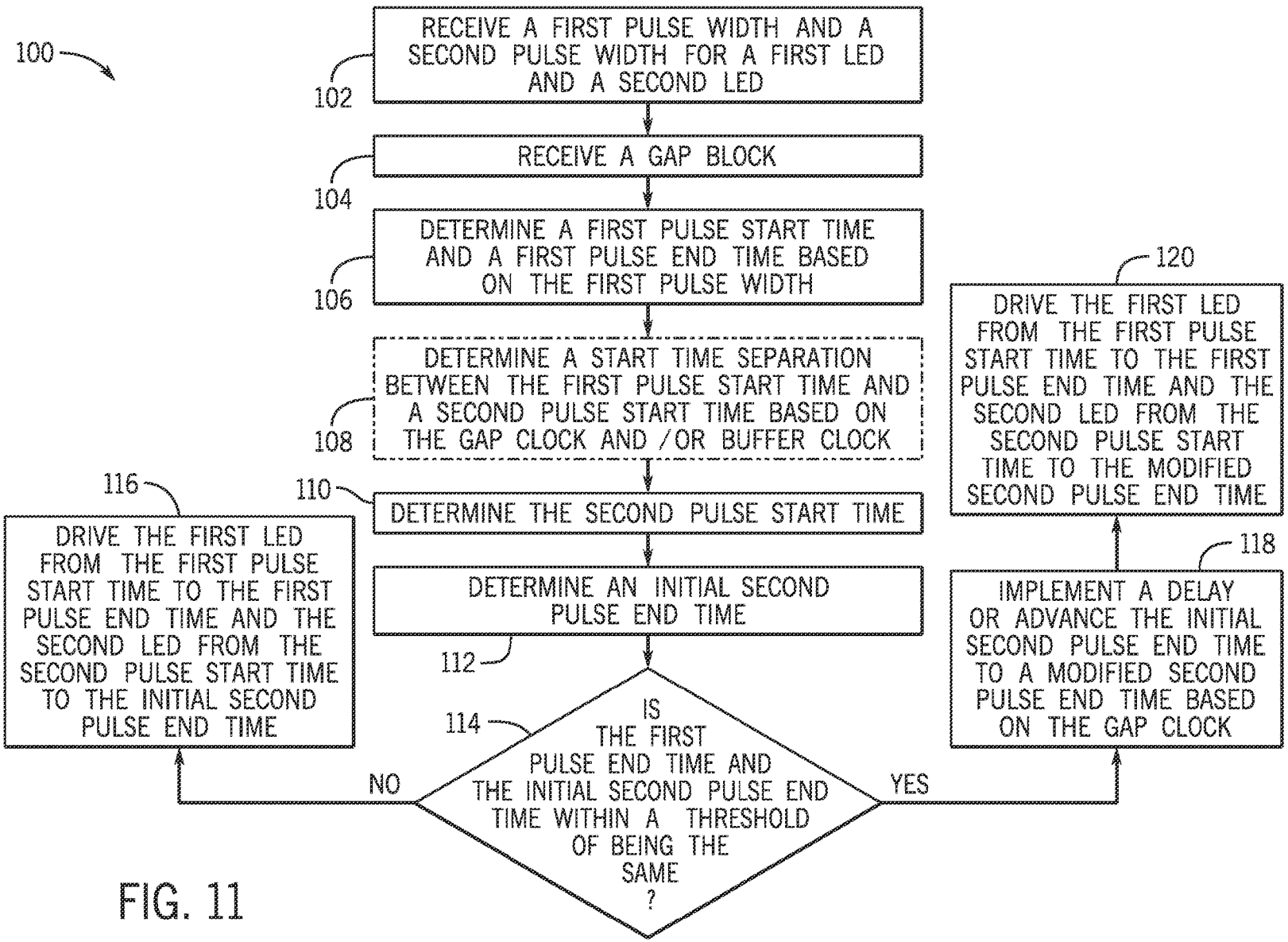
FIG. 11 is a process flow diagram for mitigating the load fluctuation, according to embodiments of the present disclosure.

FIG. 11 is a process flow diagram of a method 100 for mitigating the load fluctuation. Any suitable device that may control the electronic device 10 and/or components of the backlight system 42 (e.g., the LEDs 52), such as the processor 12 (e.g., one or more processors) and/or the driver 50, may perform the method 100. In some embodiments, the processor 12 and the driver 50 may be integrated. Moreover, in some embodiments, the method 100 may be implemented by executing instructions stored in a tangible, non-transitory, computer-readable medium, such as the memory 14 (e.g., one or more memory devices), using the processors 12. The processor 12 of the electronic device 10 may execute instructions to perform the method 100 that are stored in the memory 14 and carried out by the processor 12. While the method 100 is described using steps in a specific sequence, it should be understood that the present disclosure contemplates that the described steps may be performed in different sequences than the sequence illustrated, and certain described steps may be skipped or not performed altogether. Additionally, although the following descriptions of the method 100 describe two LEDs 52, which represents a particular embodiment, the systems and methods described herein may include two or more LEDs 52 that are driven by the driver 50. For example, the number of LEDs 52 may include each of the LEDs 52 in a zone of LEDs 52 of the backlight system 42 driven by the driver 50.

The method 100 may include the driver 50 receiving (process block 102) (e.g., from the host 62) a first pulse width 72 for a first LED 52A and a second pulse width 82 for a second LED 52B. As previously mentioned, the pulse widths may be associated with a brightness level (e.g., gray level) to be emitted by the respective LEDs 52. The driver 50 may also receive (process block 104) a gap clock 78. The gap clock 78 may include a number of units or positions in a clock cycle. For example, the gap clock 78 may include 8 gap clock positions 80 and the cycle may repeat until the driver 50 finishes driving the last LED 52.

The driver 50 may determine (process block 106) a first pulse start time and a first pulse end time based on the first pulse width 72. That is, the driver 50 may determine a first rising edge 74 for the first pulse start time and a first falling edge 76 for the first pulse end time based on the first pulse width 72. The driver 50 may determine placement of the first falling edge 76 based on the first pulse width 72 and the gap clock 78, such as by determining (e.g., calculating) a remainder as described with respect to FIGS. 9 and 10.

The driver 50 may also optionally (as indicated by the dashed line box) determine (process block 108) a start time separation 84 between the first pulse start time and a second pulse start time based on the gap clock 78 and/or a number of buffer of gap clock positions (e.g., buffer clock). That is, the driver 50 may determine a start time delay between the first rising edge 74 and the second rising edge 86. By way of example, the start time separation 84 may include 10 gap clock positions 80 (e.g., 8 gap clock positions of a gap clock cycle and two buffer gap clock positions to reduce likelihood of same or approximately the same rising edges that may cause the load fluctuation).

The driver 50 may determine (process block 110) the second pulse start time. That is, the driver 50 may determine the second rising edge 86 based on the second pulse width 82, and in some instances, the first rising edge 74, and/or the starting separation. The driver 50 may determine (process block 112) an initial second pulse end time. That is, the driver 50 may determine placement of the second falling edge 88, such as by determining the remainder as described with respect to FIGS. 9 and 10.

The driver 50 may determine whether (decision block 112) the first pulse end time and the initial second pulse end time are within a threshold of being the same. That is, the driver 50 may determine whether the first falling edge 76 of the first pulse end time is within a threshold number of gap clock positions from the second falling edge 88 of the second pulse end time, such that the pulse end times are the same or approximately the same or result in the same or approximately the same load variation. The threshold may be based a threshold level of acceptable perceivable noise that may result from the same or approximately the same falling edge placements. In some embodiments, the acceptable level may correspond to more than 1 gap clock positions (e.g., 2 or more gap clock positions). That is first falling edge 76 and the second falling edge 88 are more than one gap clock positions apart to be within a permissible threshold range.

If the first pulse end time and the initial second pulse end time are not within the threshold of being the same, the driver 50 may drive (process block 116) the first LED 52A from the first rising edge 74 of the first pulse start time to the first falling edge 76 of the first pulse end time, as well as the drive the second LED 52B from the second rising edge 86 of the second pulse start time to the second falling edge 88 of the second pulse end time. On the other hand, if the driver 50 determines that the first pulse end time and the initial second pulse end time are within the threshold of being the same, the driver 50 may implement (process block 118) a delay or advance the initial second pulse end time to a modified second pulse end time based on the gap clock 78. That is, the driver 50 may add the delay to the second rising edge 86 by specified gap clock positions, pushing placement of the second falling edge 88 along the gap clock 78, preventing the overlap of falling edges. In some embodiments, additionally or alternatively to implementing the delay at the second rising edge 86, the driver 50 may implement the delay or advance at the center of the second pulse width 82. In either implementation, placement of the second falling edge 88 changes so that it is not within the threshold.

The driver 50 may drive (process block 120) the first LED 52A from the first pulse start time to the first pulse end time and the second LED 52B from the second pulse start time to the modified second pulse end time. In this manner, the techniques described herein may prevent load transients caused by multiple LEDs 52 turning on or off at the same or approximately the same time, which may result in perceivable audible noise. Additionally, by the driver 50 performing the calculations (e.g., calculating the remainder) to determine a gap clock position for the rising and/or falling edges of the pulse widths of the LEDs 52 to prevent the same positions (e.g., overlap), the driver 50 may reduce or eliminate storage of the timings (e.g., pulse widths, rising and falling edges, etc.) in memory 14. That is, in some embodiments, the driver 50 may perform the calculations in real time. In this manner, the driver 50 may efficiently reduce load fluctuations while also reducing memory usage of the electronic device 10 by using the relationship between the pulse width timings and the gap clock.

It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ," it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A method, comprising:

receiving, via one or more processors, a first pulse width associated with a first light emitting diode, a second pulse width associated with a second light emitting diode, and a gap clock comprising a specified number of clock positions;

determining a starting edge separation between a first pulse start time for the first light emitting diode and a second pulse start time for the second light emitting diode based at least in part on the gap clock and one or more buffer gap clock positions;

determining, via the one or more processors, a first pulse start time and a first pulse end time for the first light emitting diode based at least in part on the first pulse width;

determining, via the one or more processors, a second pulse start time and a second pulse end time for the second light emitting diode based at least in part on the starting edge separation;

implementing a delay or an advancement of the second pulse end time based at least in part on the first pulse end time, the gap clock, or a combination thereof; and driving, via the one or more processors, the first light emitting diode from the first pulse start time to the first pulse end time and the second light emitting diode from the second pulse start time to the second pulse end time, wherein the first pulse end time and the second pulse end time are different.

2. The method of claim 1, comprising:

determining, via the one or more processors, a first remainder of dividing the first pulse width by a number of gap clock positions of the gap clock, wherein the first remainder corresponds to a first remainder gap clock position on the gap clock; and positioning, via the one or more processors the second pulse end time at the first remainder gap clock position.

3. The method of claim 2, comprising:

determining, via the one or more processors, a second remainder of dividing the second pulse width by the number of gap clock positions of the gap clock, wherein the second remainder corresponds to a second remainder gap clock position on the gap clock; and in response to determining that the first remainder corresponds to the second remainder, via the one or more processors, implementing the delay or the advancement of the second pulse end time.

4. The method of claim 2, comprising:

determining, via the one or processors, a second remainder of dividing the second pulse width by the number of gap clock positions of the gap clock, wherein the second remainder corresponds to a second remainder gap clock position on the gap clock; and in response to determining that the first remainder is different than the second remainder, positioning, via the one or more processors, the second pulse end time at the second remainder gap clock position.

5. The method of claim 2, comprising:

determining, via the one or processors, a second remainder of dividing the second pulse width by the number of gap clock positions of the gap clock, wherein the second remainder corresponds to a second remainder gap clock position on the gap clock; and in response to determining that the first remainder gap clock position is within a threshold gap clock positions of the second remainder gap clock position, implementing, via the one or more processors, the delay or the advancement of the second pulse end time.

6. The method of claim 5, wherein the threshold gap clock positions comprises two or more gap clock positions.

7. The method of claim 1, wherein implementing the delay or the advancement comprises shifting a gap clock position of the gap clock.

8. The method of claim 1, wherein the first pulse start time corresponds to a rising edge of the first pulse width and the first pulse end time corresponds to a falling edge of the first pulse width.

9. The method of claim 1, wherein the gap clock repeats upon completion of a cycle in response to the first pulse width, the second pulse width, or a combination thereof, comprising a greater number of gap clock positions than the gap clock positions in the cycle of the gap clock.

10. The method of claim 1, wherein the one or more processors are integrated with a driver of a display.

11. The method of claim 10, wherein the driver drives a plurality of light emitting diodes within a zone of the display.

12. The method of claim 10, wherein the driver performs the method in real time.

13. The method of claim 1, wherein the delay or the advancement is implemented at a center of the second pulse width.

14. The method of claim 1, wherein the delay or the advancement is implemented at a rising edge or a falling edge of the second pulse width.

15. A display device, comprising:

a first light emitting diode configured to emit light for a duration of a first pulse width;

a second light emitting diode configured to emit light for a duration of a second pulse width; and at least one processor of a driver of the display device, wherein the driver is configured to drive the first light emitting diode and the second light emitting diode, wherein the at least one processor is configured to:

determine the first pulse width associated with the first light emitting diode and the second pulse width associated with the second light emitting diode based at least in part on a level of brightness to be emitted by each of the first light emitting diode and the second light emitting diode;

receive a gap clock comprising a specified number of gap clock units;

determine a starting edge separation between a first pulse start time for the first light emitting diode and a second pulse start time for the second light emitting diode based at least in part on the gap clock and one or more buffer gap block units;

determine the first pulse start time and a first pulse end time for the first light emitting diode based at least in part on the first pulse width;

determine the second pulse start time based at least in part on the starting edge separation;

determine a second pulse end time for the second light emitting diode based at least in part on the first pulse end time, the second pulse width, the gap clock, or any combination thereof, wherein the first pulse end time and the second pulse end time are different; and drive the first light emitting diode from the first pulse start time to the first pulse end time and the second light emitting diode from the second pulse start time to the second pulse end time.

16. The display device of claim 15, wherein the first pulse end time and the second pulse end time are different based at least in part on a delay implemented to the first pulse width, the second pulse width, or a combination thereof.

17. The display device of claim 15, wherein the first pulse end time and the second pulse end time are different based at least in part on the starting edge separation implemented to the second pulse width.

18. The display device of claim 17, wherein the starting edge separation comprises gap clock positions corresponding to the gap clock and at least one buffer gap clock position.

19. The display device of claim 15, wherein the display device is divided into a plurality of zones, and wherein each of a plurality of drivers drive a plurality of light emitting diodes of respective zones.

20. A non-transitory computer-readable medium, comprising computer-executable instructions that, when executed by one or more processors, cause the one or more processors to:

receive a first pulse width associated with a first light emitting diode, a second pulse width associated with a second light emitting diode, and a gap clock cycle comprising a specified number of gap clock units;

determine a starting edge separation between a first pulse start time for the first light emitting diode and a second pulse start time for the second light emitting diode based at least in part on the gap clock cycle and one or more buffer gap clock units;

determine a first pulse end time for the first light emitting diode based at least in part on the first pulse start time, the first pulse width, or a combination thereof;

determine the second pulse start time based at least in part on the starting edge separation;

determine a second pulse end time for the second light emitting diode based at least in part on the first pulse end time, the second pulse start time, the second pulse width, the gap clock cycle, or any combination thereof, wherein the first pulse end time and the second pulse end time are different; and drive the first light emitting diode from the first pulse start time to the first pulse end time and the second light emitting diode from the second pulse start time to the second pulse end time.

* * * * *